US006079478A

United States Patent [19]

Grothe

[11] Patent Number: 6,079,478

[45] Date of Patent: Jun. 27, 2000

[54] DEVICE FOR THE CONTINUOUS CASTING OF STEEL

[75] Inventor: Horst Grothe, Kaarst, Germany

[73] Assignee: SMS Schloemann-Siemag Aktiengesellschaft, Düsseldorf, Germany

[21] Appl. No.: 09/088,237

[22] Filed: Jun. 1, 1998

[30] Foreign Application Priority Data

May 30, 1997 [DE] Germany ..... 197 22 733

[51] Int. Cl.[7] ..... B22D 11/04

[52] U.S. Cl. ..... 164/416; 164/478

[58] Field of Search ..... 164/416, 478

[56] References Cited

U.S. PATENT DOCUMENTS 4,612,970 9/1986 Grothe ..... 164/478
5,769,148 6/1998 Kaiser et al. ..... 164/478
5,771,957 6/1998 Von Wyl et al. ..... 164/416

FOREIGN PATENT DOCUMENTS 4341719 4/1995 Germany .

*Primary Examiner*—Harold Pyon
*Assistant Examiner*—I.-H. Lin
*Attorney, Agent, or Firm*—Friedrich Kueffner

[57] ABSTRACT

A device for the continuous casting of steel includes a continuous casting mold which oscillates in the casting direction, wherein the continuous casting mold is arranged in a lifting table of a stationary base frame, wherein the lifting table is connected to an oscillating drive, and wherein guide elements are provided for the lifting table on both sides transversely of the casting direction. The guide elements are constructed as plate-shaped frames with transverse struts and always two plate-shaped frames located opposite each other and at a distance from each other are combined to form a pair of plate-shaped frames, wherein each plate-shaped frame is connected to the base frame, on the one hand, and to the lifting table, on the other hand.

1 Claim, 2 Drawing Sheets

DEVICE FOR THE CONTINUOUS CASTING OF STEEL

BACKGROUND OF THE INVENTION

1. Field of the Invention

The present invention relates to a device for the continuous casting of steel, including a continuous casting mold which oscillates in the casting direction, wherein the continuous casting mold is arranged in a lifting table of a stationary base frame, wherein the lifting table is connected to an oscillating drive, and wherein guide elements are provided for the lifting table on both sides transversely of the casting direction.

2. Description of the Related Art

A device of the above-described type is known from DE 43 41 719 C1. In that device, the oscillating continuous casting mold is mounted on springs which are secured at both ends thereof and extend transversely of the casting direction. The springs are connected to an oscillating drive constructed as servo hydraulic cylinders which are rigidly connected to a support frame. In a continuous casting mold composed of long side walls and short side walls, the short side walls are clamped between the long side walls by means of clamping devices which act on the long side walls. The short side walls are fastened to fastening blocks, wherein the springs are also fastened through clamping means to the upper and lower sides of the fastening blocks. The springs are at both ends arranged in clamping blocks and the clamping blocks are secured by additional fastening blocks arranged on the support frame. It is apparent that this construction is very complicated and is particularly very disadvantageous when the guide springs must be exchanged because, due to the frequency of the oscillation, these guide springs are subjected to continuously alternating bending stresses.

SUMMARY OF THE INVENTION

Therefore, it is the primary object of the present invention, in a device of the above-described type, to provide a guide unit with guide elements which have improved properties particularly with respect to their service life and wear.

In accordance with the present invention, the guide elements are constructed as plate-shaped frames with transverse struts and always two plate-shaped frames located opposite each other and at a distance from each other are combined to form a pair of plate-shaped frames, wherein each plate-shaped frame is connected to the base frame, on the one hand, and to the lifting table, on the other hand.

Accordingly, the present invention does not use the conventional guide elements in the form of springs, ropes or round rods. Rather, the present invention is based on the finding that, when the plate-shaped frames or guide frames are arranged opposite each other and serve as a connecting member between the base and the oscillating lifting table which supports the mold, the transverse struts carry out a bending spring function as well as a tension rod function, i.e., the transverse struts are deformed as a result of tension and bending. In spite of a permissible oscillation movement of plus/minus 10 mm, the geometric changes, i.e., displacements of the transverse struts from the middle position, can be kept so low that the permissible stress for fatigue strength is not exceeded either by bending or by tension (or shearing forces).

The service life of the guide or plate-shaped frames is unlimited and the elements additionally require no maintenance. The assembly or mounting of the plate-frames is very simple and essentially merely requires that the base frame is unscrewed and removed, for example, by means of a travelling crane. The necessary assembly area is then freely accessible. In addition, the entire guide system composed of the plate-shaped frame is without play and transverse crossbeams are not required.

In accordance with another embodiment of the invention, each plate-shaped frame is composed of two vertical side plates constructed in situ and provided with horizontal plates as transverse struts connecting the side plates. The transverse struts can be welded to the side plates; alternatively, it is possible to manufacture such a plate-shaped frame from a solid block, for example, by flame cutting from a slab and subsequently processing by cutting and/or grinding.

In accordance with an advantageous feature, the side plates are provided with fastening bores. This makes it possible to connect the plate-shaped frames with the side walls as clamping members in a simple manner by screwing to the lifting table and the base frame.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
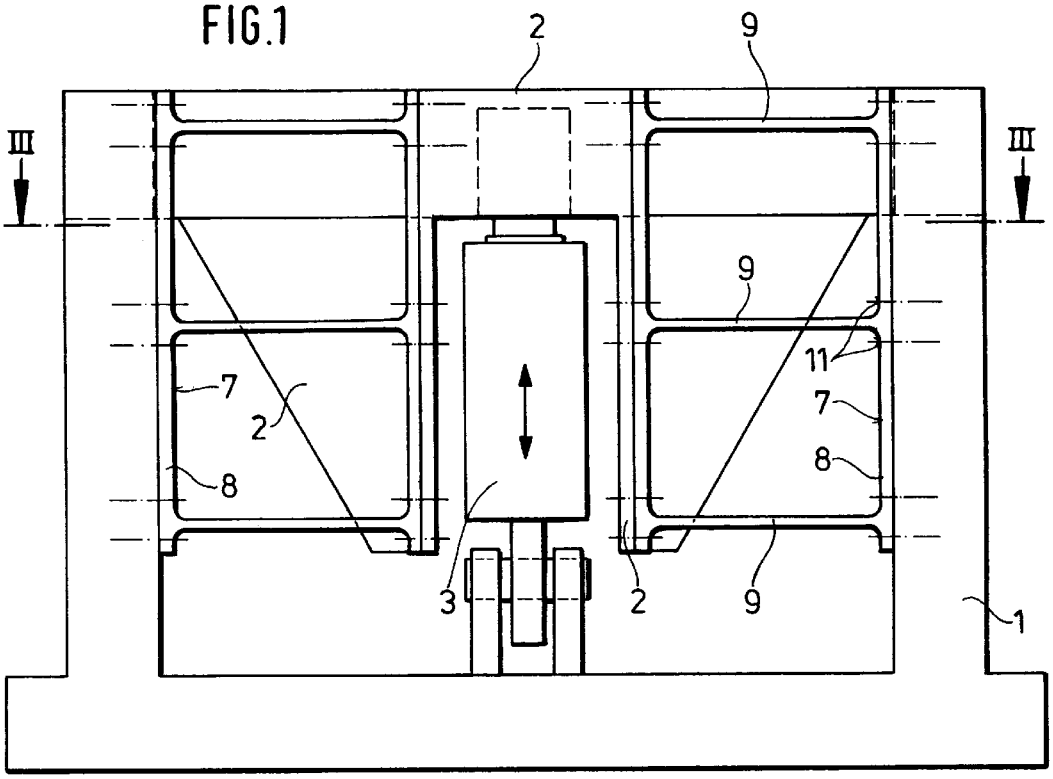
FIG. 1 is a schematic side view showing a lifting table of a continuous casting mold arranged in a stationary base frame and forming part of a conventional continuous casting plant.
Figure 2:
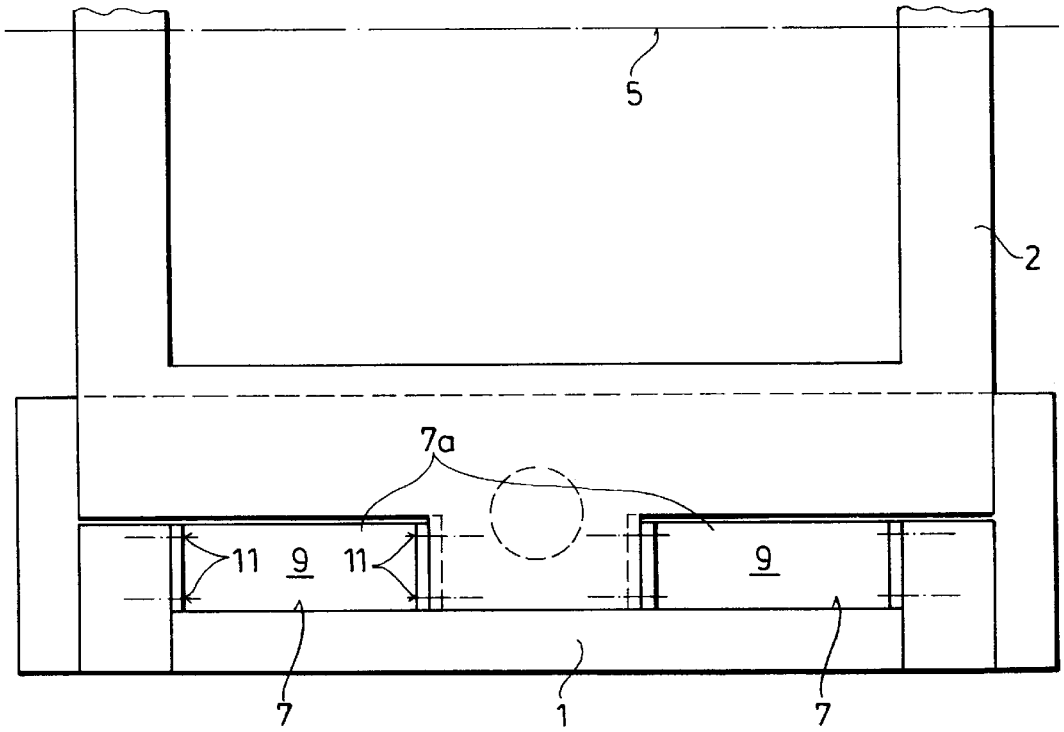
FIG. 2 is a semi-symmetrical top view of the arrangement of FIG. 1.

As illustrated in FIGS. 1 and 2, a lifting table 2 is arranged in a stationary base frame 1 of a continuous casting plant, not shown. A servo hydraulic cylinder 3 connected to the base frame 1 acts as an oscillating drive on the lifting table 2. The lifting table 2 which has a small mass can be constructed as a single table or, as shown in FIG. 3, in the form of two separate lifting tables arranged to the left and right or front and rear.

Figure 3:
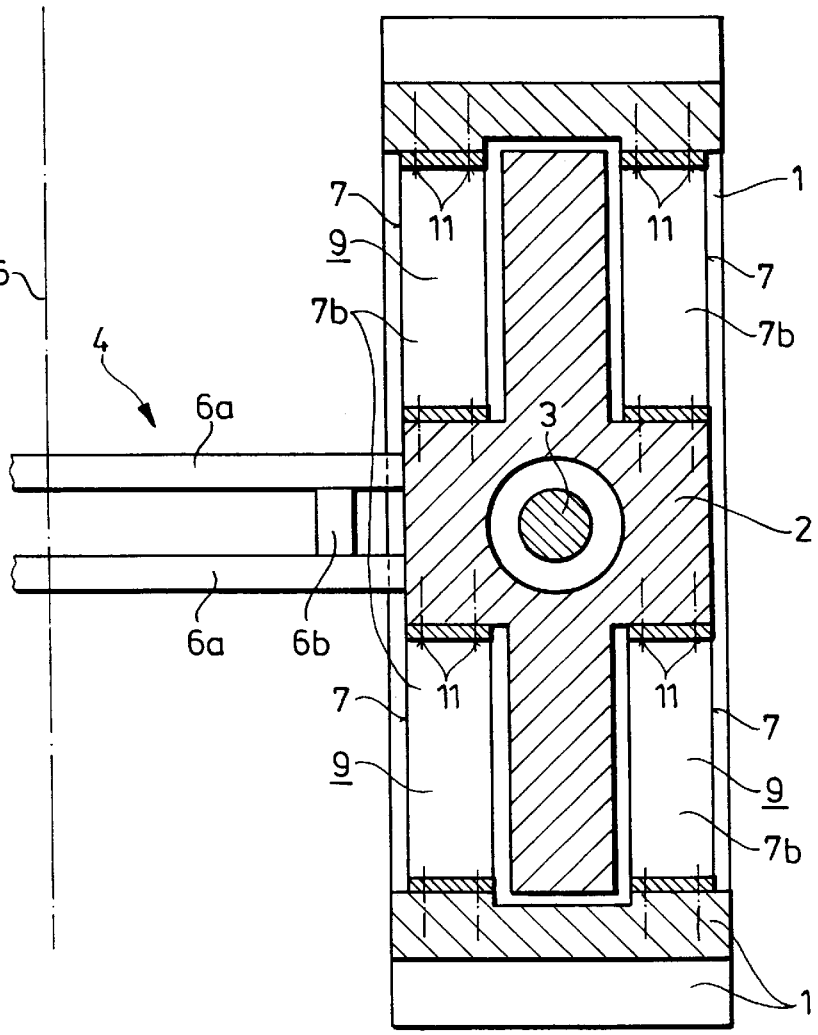
FIG. 3 is a schematic sectional view taken along sectional line III—III of FIG. 1.

As also illustrated in FIG. 3, a continuous casting mold 4 is composed of long side walls 6*a* and short side walls 6*b*. In FIG. 3, only a portion of the mold 4 is shown, namely, a portion extending slightly beyond the center 5 of the strand. The lifting table 2 supporting the mold 4 is guided, depending on its construction, i.e., one table or two separate table units, either in a pair of plate-shaped frames or, as illustrated in FIG. 3, in four individual plate-shaped frames 7 as guide elements which are required because of the separated construction.

Always two plate-shaped frames located opposite each other and at a distance from each other form a pair 7*a* of plate-shaped frames, shown in FIG. 2, or 7*b*, shown in FIG. 3. Because of this double-sided connection, no horizontal force components occur; rather, forces are produced which always return the system into the center.

Figure 4A:
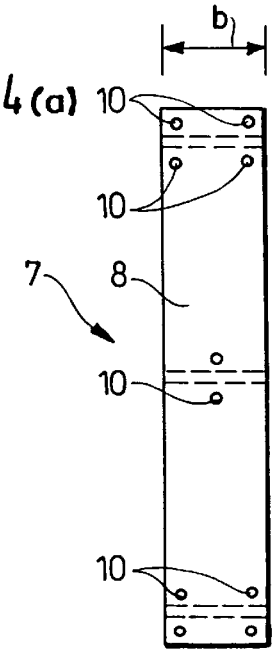
FIG. 4*a* is a side view of a guide frame or plate-shaped frame.

As illustrated in FIG. 4, the plate-shaped frames 7 are composed of two side plates 8 and transverse struts 9 constructed in the form of horizontal plates which connect the side plates 8 to each other. The side plates 8 are manufactured from the outside each with fastening bores 10 arranged slightly above and below the transverse struts 9, as shown in FIG. 4*a*, so that they can be easily connected to each other by means of screws 11 which are only schematically shown in FIGS. 1 to 3, to the base frame 1 and the lifting table 2.

Figure 4B:
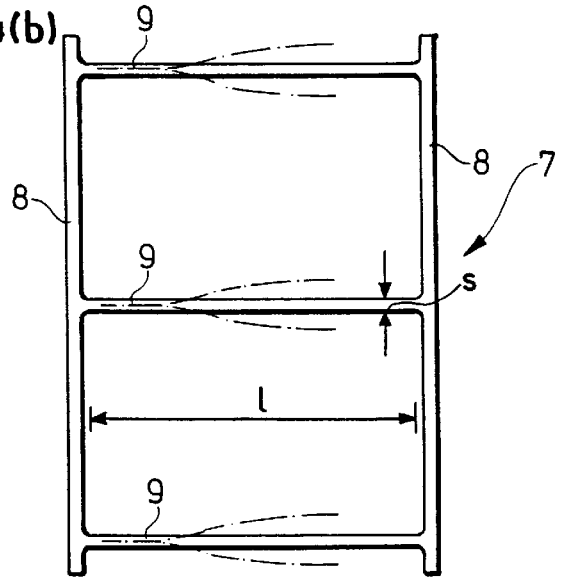
FIG. 4*b* is a front view of the guide frame or plate-shaped frame.

When oscillating movements of the lifting table 2 occur as indicated by a double arrow in FIG. 1, wherein these oscillating movements may be in the range of plus/minus 10 mm, the transverse struts 9 are bent as a result of the movements either upwardly or downwardly, as indicated in FIG. 4*b* by dash-dot lines, wherein, for clarity's sake, the movement is shown exaggerated. In fact, the geometric changes, the displacements from the center position, are so small as a result of the dimensioning of the plate-shaped frames that the permissible stress for fatigue strength is not exceeded either by bending or by tension or shearing forces. The dimensions l and b and s of the plate-shaped frames indicated in FIGS. 4*a* and 4*b* determine the manner of operation and depend on the load, i.e, when the load is greater, the dimensions are larger and vice versa.

While specific embodiments of the invention have been shown and described in detail to illustrate the inventive principles, it will be understood that the invention may be embodied otherwise without departing from such principles.

What is claimed is:

1. A device for continuously casting steel, the device comprising: a continuous casting mold configured to be oscillating in a casting direction, guide elements and a stationary base frame with a lifting table having a width, wherein the lifting table is connected to an oscillating drive and is provided with the guide elements arranged on both sides of the casting mold, wherein the guide elements comprise plate-shaped frames having two vertical side plates and horizontal plates functioning as transverse struts connecting the side plates, wherein always two plate-shaped frames located opposite each other and at a distance from each other are configured to form a pair of plate-shaped frames extending over the width of the lifting table, and wherein the side plates having fastening bores for connecting the plate-shaped frames to the base frame and to the lifting table.

* * * * *